US008999080B2

(12) United States Patent
Souda et al.

(10) Patent No.: US 8,999,080 B2
(45) Date of Patent: Apr. 7, 2015

(54) CASTING ALUMINUM ALLOY AND INTERNAL COMBUSTION ENGINE CYLINDER HEAD

(75) Inventors: Hiroshi Souda, Yokohama (JP); Kouichi Akiyama, Yokohama (JP); Hiroshi Horikawa, Shizouka (JP); Masahiko Shioda, Yokohama (JP)

(73) Assignees: Nissan Motor Co., Ltd., Yokohama-shi (JP); Nippon Light Metal Company, Ltd., Tokyo (JP)

( * ) Notice: Subject to any disclaimer, the term of this patent is extended or adjusted under 35 U.S.C. 154(b) by 354 days.

(21) Appl. No.: 12/166,893

(22) Filed: Jul. 2, 2008

(65) Prior Publication Data

US 2009/0010799 A1 Jan. 8, 2009

(30) Foreign Application Priority Data

Jul. 6, 2007 (JP) ..... 2007-177983

(51) Int. Cl.

| | |
|---|---|
| ***C22C 21/02*** | (2006.01) |
| ***C22C 21/08*** | (2006.01) |
| ***C22C 21/16*** | (2006.01) |
| ***C22F 1/043*** | (2006.01) |
| ***C22C 21/04*** | (2006.01) |
| ***F02F 1/24*** | (2006.01) |

(52) U.S. Cl.

CPC ..... *C22F 1/043* (2013.01); *C22C 21/02* (2013.01); *C22C 21/04* (2013.01); *F02F 1/24* (2013.01)

(58) Field of Classification Search

USPC ..... 420/534, 535; 148/439

See application file for complete search history.

(56) References Cited

U.S. PATENT DOCUMENTS

| | | | | |
|---|---|---|---|---|
| 3,128,176 | A | 4/1964 | Martin | |
| 4,077,810 | A | 3/1978 | Ohuchi et al. | |
| 4,786,340 | A | 11/1988 | Ogawa et al. | |
| 5,837,070 | A | 11/1998 | Sainfort et al. | |
| 2003/0089759 | A1* | 5/2003 | Kusunoki et al. | 228/112.1 |
| 2004/0045638 | A1 | 3/2004 | Garat et al. | |
| 2005/0199318 | A1* | 9/2005 | Doty | 148/439 |
| 2006/0021683 | A1 | 2/2006 | Lin et al. | |

FOREIGN PATENT DOCUMENTS

| | | | | |
|---|---|---|---|---|
| EP | 0 488 670 | A1 | | 6/1992 |
| EP | 1 715 084 | A1 | | 10/2006 |
| FR | 2 268 084 | A1 | | 11/1975 |
| FR | 2 588 017 | A1 | | 4/1987 |
| JP | 55-50451 | A | | 4/1980 |
| JP | 63-259045 | A | | 10/1988 |
| JP | 6-145866 | A | | 5/1994 |
| JP | 9-31581 | A | | 2/1997 |
| JP | 9-272942 | A | | 10/1997 |
| JP | 10-204566 | A | | 8/1998 |
| JP | 11-12673 | A | | 1/1999 |
| JP | 11-246925 | A | | 9/1999 |
| JP | 2001-131669 | A | | 5/2001 |
| JP | 2003-136198 | A | | 5/2003 |
| JP | 2004-225134 | A | | 8/2004 |
| JP | 2004-232087 | A | | 8/2004 |
| JP | 2006-169594 | A | | 6/2006 |
| JP | 2007023330 | A | * | 2/2007 |
| JP | 2007-169731 | A | | 7/2007 |
| KR | 2003092718 | A | * | 12/2003 |
| WO | WO 95/34691 | A1 | | 12/1995 |

OTHER PUBLICATIONS

Sasaki et al., English machine translation of JP 2007-023330, Feb. 2007.*

Hojo et al., English translation of JP 63-259045, Japan, Oct. 1988, p. 1-12.*

Han, Do-Seok, English machine translation fo KR 2003-0092718, Republic of Korea, Dec. 2003, p. 1-6.*

Feikus, F. J., "Optimierung von Aluminium-Silicium-Gußlegierungen für Zylinderköpfe", *Giessereipraxis, Fachverlag Schiele Und Schon GmBH*, No. 2, (Jan. 1, 1999), pp. 50-57.

* cited by examiner

*Primary Examiner* — Roy King
*Assistant Examiner* — Caitlin Kiechle
(74) *Attorney, Agent, or Firm* — Foley & Lardner LLP

(57) ABSTRACT

Disclosed are: a casting aluminum alloy that is excellent in elongation as alternative properties of a high cycle fatigue strength and a thermal fatigue strength and is suitably usable for a casting for which both of the excellent high cycle fatigue strength and the excellent thermal fatigue strength are required, for example, an internal combustion engine cylinder head; a casting made of the aluminum alloy; a manufacturing method of the casting; and further, an internal combustion engine cylinder head composed of the aluminum alloy casting and manufactured by the manufacturing method of the casting. The casting aluminum alloy contains, in terms of mass ratios, 4.0 to 7.0% of Si, 0.5 to 2.0% of Cu, 0.25 to 0.5% of Mg, no more than 0.5% of Fe, no more than 0.5% of Mn, and at least one component selected from the group consisting of Na, Ca and Sr, each mass ratio of which is 0.002 to 0.02%.

8 Claims, 3 Drawing Sheets

FIG. 2

| SECTION | ALLOY COMPONENT (MASS%) | | | | | | | | AGING TEMPERA-TURE (℃) | PERFORMANCE OF CASTING | | |
|---|---|---|---|---|---|---|---|---|---|---|---|---|
| | Si | Cu | Mg | Fe | Mn | Sr | Ti | RESIDUE | | FATIGUE STRENGTH (MPa) | FRACTURE ELONGATION (%) | HARDNESS (HRB) |
| EXAMPLE 1 | 4.7 | 0.8 | 0.33 | 0.13 | 0.07 | 0.006 | 0.100 | Al | 200 | 115 | 11.1 | 54 |
| EXAMPLE 2 | 5.6 | 0.8 | 0.33 | 0.13 | 0.07 | 0.006 | 0.100 | Al | 200 | 117 | 12.3 | 56 |
| EXAMPLE 3 | 4.7 | 0.8 | 0.43 | 0.13 | 0.07 | 0.006 | 0.100 | Al | 220 | 119 | 11.1 | 55 |
| EXAMPLE 4 | 5.6 | 0.8 | 0.43 | 0.13 | 0.07 | 0.006 | 0.100 | Al | 220 | 124 | 10.9 | 57 |
| EXAMPLE 5 | 4.7 | 1.3 | 0.33 | 0.13 | 0.07 | 0.006 | 0.100 | Al | 220 | 120 | 11.4 | 54 |
| EXAMPLE 6 | 5.6 | 1.3 | 0.33 | 0.13 | 0.07 | 0.006 | 0.100 | Al | 220 | 122 | 10.9 | 55 |
| EXAMPLE 7 | 4.7 | 1.3 | 0.43 | 0.13 | 0.07 | 0.006 | 0.100 | Al | 240 | 109 | 13.2 | 55 |
| EXAMPLE 8 | 5.6 | 1.3 | 0.43 | 0.13 | 0.07 | 0.006 | 0.100 | Al | 200 | 124 | 10.9 | 58 |
| EXAMPLE 9 | 5.6 | 1.3 | 0.33 | 0.13 | 0.07 | 0.006 | 0.100 | Al | 220 | 112 | 10.7 | 53 |
| COMPARATIVE EXAMPLE 1 | 5.6 | 0.4 | 0.33 | 0.13 | 0.07 | 0.006 | 0.100 | Al | 200 | 93 | 12.7 | 52 |
| COMPARATIVE EXAMPLE 2 | 5.6 | 2.1 | 0.33 | 0.13 | 0.07 | 0.006 | 0.100 | Al | 220 | 132 | 8.9 | 55 |
| COMPARATIVE EXAMPLE 3 | 3.5 | 1.3 | 0.33 | 0.13 | 0.07 | 0.006 | 0.100 | Al | 200 | 103 | 9.5 | 54 |
| COMPARATIVE EXAMPLE 4 | 7.0 | 1.3 | 0.33 | 0.13 | 0.07 | 0.006 | 0.100 | Al | 220 | 114 | 10.9 | 55 |
| COMPARATIVE EXAMPLE 5 | 5.6 | 1.3 | 0.23 | 0.13 | 0.07 | 0.006 | 0.100 | Al | 220 | 92 | 10.8 | 53 |
| COMPARATIVE EXAMPLE 6 | 5.6 | 1.3 | 0.55 | 0.13 | 0.07 | 0.006 | 0.100 | Al | 220 | 113 | 7.6 | 57 |
| COMPARATIVE EXAMPLE 7 | 5.6 | 1.3 | 0.33 | 0.55 | 0.30 | 0.006 | 0.100 | Al | 220 | 112 | 5.1 | 54 |
| COMPARATIVE EXAMPLE 8 | 5.6 | 1.3 | 0.33 | 0.13 | 0.07 | <0.001 | 0.100 | Al | 200 | 113 | 8.9 | 54 |
| COMPARATIVE EXAMPLE 9 | 5.6 | 1.3 | 0.33 | 0.13 | 0.07 | 0.006 | 0.100 | Al | 180 | 133 | 6.4 | 73 |
| COMPARATIVE EXAMPLE 10 | 5.6 | 1.3 | 0.33 | 0.13 | 0.07 | 0.006 | 0.100 | Al | 260 | 81 | 14.4 | 34 |
| CONVENTIONAL MATERIAL 1 | 7.0 | 0.05 | 0.35 | 0.13 | 0.07 | 0.006 | 0.100 | Al | 190 | 83 | 8.3 | 52 |
| CONVENTIONAL MATERIAL 2 | 5.0 | 3.5 | 0.15 | 0.55 | 0.30 | 0.006 | 0.100 | Al | 210 | 78 | 1.5 | 65 |

CONVENTIONAL MATERIAL 1: AC4CH, CONVENTIONAL MATERIAL 2: AC2A

FIG. 3

| SECTION | ALLOY COMPONENT (MASS%) | | | | | | | | AGING TEMPERA-TURE (℃) | PERFORMANCE OF CASTING | | |
|---|---|---|---|---|---|---|---|---|---|---|---|---|
| | Si | Cu | Mg | Fe | Mn | Sr | Ti | RESIDUE | | FATIGUE STRENGTH (MPa) | SIMPLE THERMAL FATIGUE LIFETIME (CYCLE) | HARDNESS (HRB) |
| EXAMPLE 2-2 | 5.6 | 0.8 | 0.33 | 0.13 | 0.07 | 0.006 | 0.100 | Al | 200 | 94 | 131 | 58 |
| EXAMPLE 6-2 | 5.6 | 1.3 | 0.33 | 0.13 | 0.07 | 0.006 | 0.100 | Al | 220 | 98 | 122 | 56 |
| COMPARATIVE EXAMPLE 4-2 | 7.0 | 1.3 | 0.33 | 0.13 | 0.07 | 0.006 | 0.100 | Al | 220 | 82 | 113 | 54 |
| COMPARATIVE EXAMPLE 8-2 | 5.6 | 1.3 | 0.33 | 0.13 | 0.07 | <0.001 | 0.100 | Al | 220 | 81 | 78 | 55 |
| CONVENTIONAL MATERIAL 1-2 | 7.0 | 0.05 | 0.35 | 0.13 | 0.07 | 0.006 | 0.100 | Al | 190 | 76 | 94 | 53 |
| CONVENTIONAL MATERIAL 2-2 | 5.0 | 3.5 | 0.15 | 0.55 | 0.30 | 0.006 | 0.100 | Al | 210 | 71 | 17 | 63 |

CASTING ALUMINUM ALLOY AND INTERNAL COMBUSTION ENGINE CYLINDER HEAD

BACKGROUND OF THE INVENTION

1. Field of the Invention

The present invention relates to a casting aluminum alloy and a heat treatment method thereof. More specifically, the present invention relates to an aluminum alloy suitably used for a member for which both of an excellent high cycle fatigue strength and an excellent thermal fatigue strength are required, to a casting made of the alloy, and a manufacturing method of the casting. Moreover, the present invention relates to an internal combustion engine cylinder head composed of the aluminum alloy and manufactured by the manufacturing method of the casting.

2. Description of the Related Art

As a casting alloy that has a complicated shape, for which excellent mechanical properties are required, heretofore, aluminum alloy castings have been used, which are of Al—Cu—Si series defined as AC2A, AC2B and AC4B in JIS H 5202, and of Al—Mg—Si series defined as AC4C and AC4CH therein. As castings of these alloys, there are a cylinder head, a cylinder block and the like for an internal combustion engine.

In these castings, as disclosed in Japanese Patent Laid-Open Publication No. 2006-169594, it is frequent that casting bodies are used, which have been subjected to T6 treatment (aging treatment at a tempering temperature, at which the maximum strength is obtained, after solution heat/quenching treatment) or T7 treatment (treatment for ensuring dimensional stability by overaging after solution heat/quenching treatment) for the purpose of enhancing strength and ductility.

However, in such a conventional internal combustion engine cylinder head, as engine power has been increased and the cylinder head has been thinned aiming at weight reduction of a vehicle body in recent years, a cyclic stress has tended to be increased. In addition, the cylinder head has had a structure in which a high residual stress generated at the time of the T6 or T7 heat treatment is locally concentrated. Accordingly, in the aluminum alloy casting as described above, it cannot be said that elongation thereof as alternative properties of the high cycle fatigue strength and the thermal fatigue strength is sufficient, and there has been a problem of an increased possibility of a fatigue crack occurrence. Such fatigue cracks may occur from stress-concentrated portions of a top deck and water jacket of the cylinder head, and from a high-temperature portion of an inter-valve portion in a combustion chamber.

The present invention has been made focusing attention on the above-described problem in the conventional aluminum alloy casting. It is an object of the present invention to provide a casting aluminum alloy that is excellent in elongation as the alternative properties of the thermal fatigue strength and the high cycle fatigue strength and is suitably usable for a casting for which both of the excellent high cycle fatigue strength and the excellent thermal fatigue strength are required, for example, an internal combustion engine cylinder head, to provide a casting made of the aluminum alloy, to provide a manufacturing method of the casting, and further, to provide an internal combustion engine cylinder head composed of the aluminum alloy casting, and to provide an internal combustion engine cylinder head manufactured by the manufacturing method of the casting.

SUMMARY OF THE INVENTION

As a result of repeating assiduous studies on alloy components, a heat treatment method and the like in order to achieve the above-described objects, the inventors of the present invention found out that the above-described problem can be solved by specifying each of Si, Cu and Mg contents, by performing the T7 treatment for the obtained alloy casting, and so on. In such a way, the inventors came to accomplish the present invention.

Specifically, the present invention has been made based on the above-described finding. A casting aluminum alloy according to the present invention includes: in terms of mass ratios, 4.0 to 7.0% of Si, 0.5 to 2.0% of Cu, 0.25 to 0.5% of Mg, no more than 0.5% of Fe, no more than 0.5% of Mn, and further, at least one component selected from the group consisting of Na, Ca and Sr, each content of which is 0.002 to 0.02%; and Al and inevitable impurities, which are residues.

Moreover, in addition to the components ranging from Si to Sr, the casting aluminum alloy according to the present invention further includes: at least one component selected from the group consisting of Ti, B and Zr, each content of which is 0.005 to 0.2% in terms of the mass ratio.

Furthermore, an aluminum alloy casting according to the present invention is characterized in that the aluminum alloy casting is composed of the above-described alloy of the present invention. Moreover, a method for manufacturing an aluminum alloy casting according to the present invention includes: performing, for the above-described aluminum alloy casting, T7 treatment, that is, solution heat treatment for rapidly cooling the aluminum alloy casting after holding the aluminum alloy casting at a temperature of 500 to 550° C. for 2.0 to 8.0 hours; and performing, for the above-described aluminum alloy casting, aging treatment for cooling the aluminum alloy casting after holding the aluminum alloy casting at a temperature of 190 to 250° C. for 2.0 to 6.0 hours.

Moreover, a cylinder head for an internal combustion engine according to the present invention is characterized in that the cylinder head is composed of the above-described aluminum alloy casting according to the present invention, and further, is characterized in that the cylinder head is manufactured by the above-described manufacturing method, in other words, is subjected to the above-described T7 treatment.

In accordance with the present invention, since each of Si, Cu and Mg, which are contained in the casting aluminum alloy, is limited to the specific range, and so on, the elongation of the casting by the alloy concerned can be enhanced, and the casting excellent in both of the high cycle fatigue strength and the thermal fatigue strength, for example, the internal combustion engine cylinder head excellent therein can be obtained.

BRIEF DESCRIPTION OF THE DRAWINGS

FIG. 2 shows high cycle fatigue strength, fracture elongation, and hardness Rockwell B-scale (HRB) of test pieces.

FIG. 3 shows high cycle fatigue strength, fracture elongation, and hardness Rockwell B-scale (HRB) of test pieces.

DETAILED DESCRIPTION OF THE PREFERRED EMBODIMENTS

Figure 1:
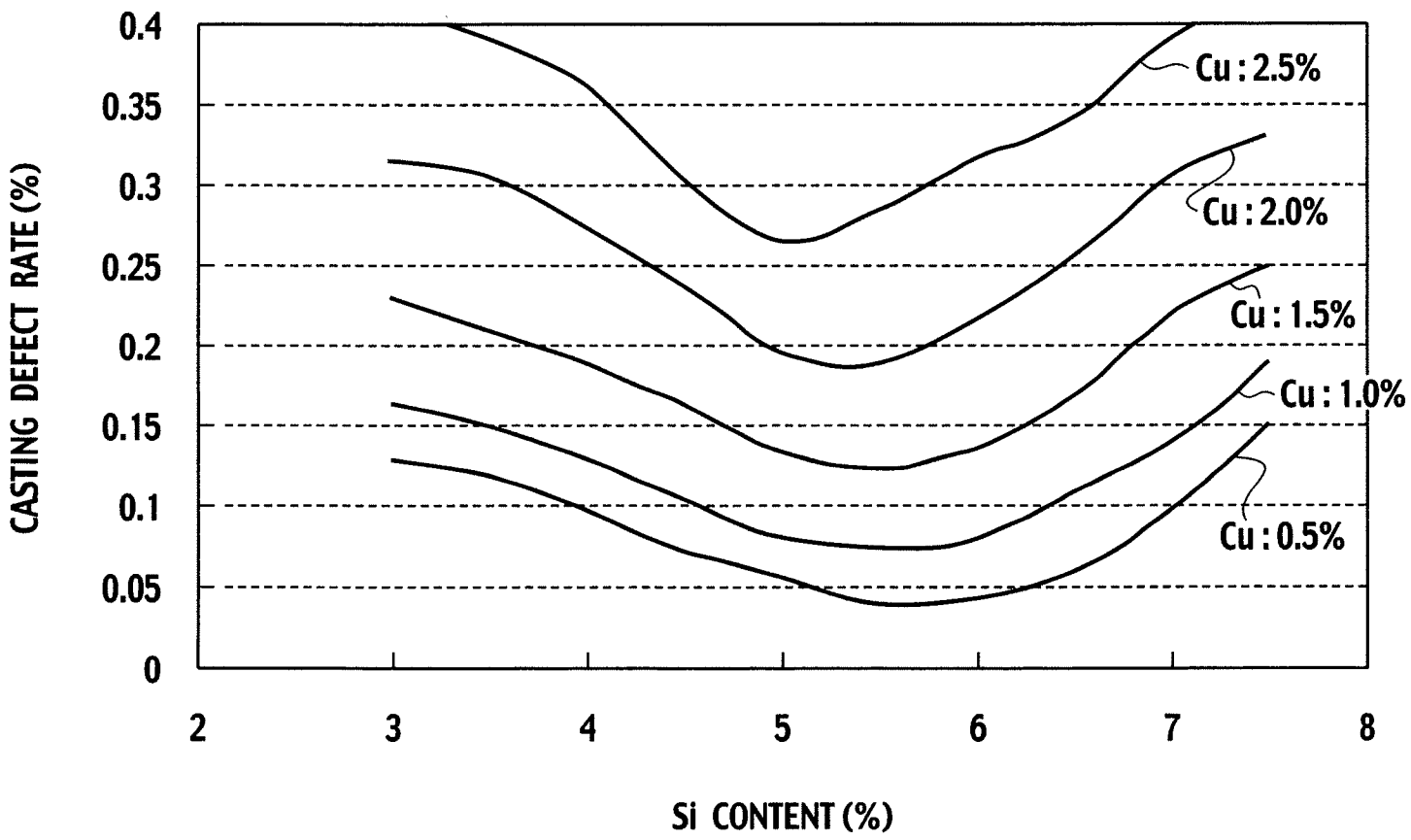
FIG. 1 is a graph showing influences of a Si content and a Cu content, which are given to a generated amount of casting defects, as results of a shrinkage test for a casting aluminum alloy.

A description will be made below in detail of a casting aluminum alloy of the present invention and an aluminum alloy casting made of the alloy together with limitation reasons such as alloy components and heat treatment conditions, functions thereof, and the like. Note that, in this specification, "%" represents a mass percent unless otherwise specified.

(1) Si Content 4.0 to 7.0%

Si (silicon) has a function to enhance castability. Accordingly, in the case of casting an article, such as a cylinder head, having a complicated shape and a thin-walled portion, it is necessary to add some amount of Si to the article from a viewpoint of fluidity of molten metal (molten aluminum alloy), that is, moldability of a casting. Specifically, if a Si content is less than 4.0%, then the fluidity of the molten aluminum alloy becomes insufficient. Moreover, a semisolid region is spread, shrinkage cavities are dispersed to cause porosities, and a shrink breakage becomes prone to occur. Moreover, Si has a function to enhance a mechanical strength, abrasion resistance and vibration resistance of a casting material.

However, as the Si content is increased, thermal conductivity and ductility of the alloy are decreased, leading to a deterioration of thermal fatigue properties. If the Si content exceeds 7.0%, then elongation of the alloy is decreased significantly, and moreover, the alloy begins to exhibit a tendency to concentrate the shrinkage cavities. Accordingly, an occurrence of porous cavities is sometimes seen.

FIG. 1 is a graph showing results of a shrinkage test. Specifically, FIG. 1 shows results, each of which is of measuring a casting defect rate from a difference between a standard specific gravity of the alloy and a specific gravity of a bottom center of a test piece, which was measured by the Archimedean method when the test piece was cast into a conical shape. From this graph, it is understood that casting defects (sum of the porosities and the porous cavities) become the minimum when the Si content is 4.0 to 7.0%, and in addition, an amount of the casting defects is reduced as a Cu content becomes smaller.

Note that it is more preferable that the Si content be within a range of 5.0 to 7.0%.

(2) Cu Content: 0.5 to 2.5%

Cu (copper) has an effect to enhance the mechanical strength of the aluminum alloy. This effect becomes significant when a Cu content becomes 0.5% or more. However, as the Cu content is increased, the thermal conductivity and ductility of the alloy are decreased, leading to the deterioration of the thermal fatigue properties. Moreover, as the Cu content is increased, a coagulation form of the alloy becomes like mush, and the shrinkage cavities are dispersed to cause the porosities.

As apparent from FIG. 1, if the Si content is unchanged, then the amount of casting defects is increased as the Cu content is increased, and adverse effects from such an increase of the Cu content become significant by the fact that the Cu content exceeds 2.5%. Accordingly, the Cu content is set within a range of 0.5 to 2.5%, more preferably within a range of 0.8 to 1.3%.

(3) Mg: 0.25 to 0.5%

If Mg (magnesium) is added to the alloy, then the alloy exhibits a tendency to increase a tensile strength and hardness by being subjected to heat treatment, and to decrease a thermal fatigue strength and elongation thereby. If Mg is added excessively, then Mg is precipitated as $Mg_2Si$ to decrease the thermal fatigue strength and the elongation. Accordingly, an added amount of Mg is set within a range of 0.25 to 0.5%, more preferably within a range of 0.3 to 0.4%.

By setting the added amount of Mg within the above-described range, a matrix of the alloy is strengthened by aging precipitation of an intermediate phase of $Mg_2Si$. Meanwhile, if the Mg content exceeds 0.5%, then a surface oxidation amount of the molten aluminum alloy is significantly increased to cause a malfunction that inclusion defects are increased.

(4) Fe: 0.5% or Less

Fe (iron) is precipitated as a needle-like iron compound, and in general, adversely affects the tensile strength, the fatigue strength, the thermal fatigue strength, the elongation, and the like. Accordingly, an upper limit value of a Fe content is set at 0.5%.

Note that, since Fe is a harmful component as described above, a smaller content thereof is desirable. It is preferable that the Fe content be set at 0.2% or less. Moreover, it is ideal that the Fe content be substantially 0%.

(5) Mn: 0.5% or Less

By adding Mn (manganese) to the alloy, a shape of such a crystallized object containing Fe can be changed from the needle shape that is prone to bring up the decrease of the strength to a massive shape that is less likely to cause a stress concentration.

If a Mn content is larger than necessary, then an amount of the iron compound (Al—Fe, Mn—Si) is increased. Accordingly, the Mn content is set at 0.5% or less, desirably 0.2% or less. Note that a ratio of Fe: Mn becomes preferably 1:1 to 2:1.

(6) One or More of Na, Ca and Sr: 0.002 to 0.02% Per Each

In particular, with regard to a material of the cylinder head, in order to enhance thermal fatigue resistance thereof, it is desirable that one or more of these components (Na, Ca and Sr) be added to the alloy, thereby microfabricating Si particles in a cast texture.

By the improvement treatment for the Si particles, mechanical properties of the alloy, such as the tensile strength and the elongation, are enhanced, and the thermal fatigue strength is also enhanced. However, if the above-described components are added in large amounts, then a region occurs, where a band-like coarse Si phase is crystallized. Such an occurrence of the coarse Si phase is called over modification, and sometimes results in the decrease of the strength. Accordingly, in the case where these components described above are added to the alloy, a content of each thereof is set within a range of 0.002 to 0.02%. Note that, for a surface of a combustion chamber, where the thermal fatigue strength is an important subject, it is desirable that the alloy be rapidly cooled and coagulated, thereby reducing dendrite arm spacing to 30 μm or less.

(7) One or More of Ti, B and Zr: 0.005 to 0.2% Per Each

Each of these components (Ti, B and Zr) is an effective component for microfabrication of crystal particles of the cast texture, and accordingly, is added to the alloy according to needs within a range of 0.005 to 0.2%. Moreover, these components are added in a component range where the amount of the casting defects is large, whereby the porous cavities are dispersed, and the shrinkage cavities are removed.

In the case where the added amount of each of these components is less than 0.005%, no effect is brought up. In the case where the added amount exceeds 0.2%, Al—Fe, Al—B, Al—Zr, TiB, ZrB and the like, which become cores of the crystal particles, are coagulated, whereby a risk of causing the defects is increased.

(8) T7 Treatment (Solution Heat Treatment, and then Stabilization Treatment)

Solution heat treatment: rapid cooling after holding at 500 to 550° C. for 2.0 to 8.0 hours Aging treatment: air cooling after holding at 190 to 250° C. for 2.0 to 6.0 hours Usually, in order to enhance the strength, the cylinder head is subjected to T6 treatment (solution heat treatment, and then artificial aging treatment) or T7 treatment. In the present invention, though being slightly inferior in strength to the T6 treatment, the T7 treatment (solution heat treatment, and then stabilization treatment) is performed since the enhancement of the thermal fatigue strength, the reduction of the residual stress, and the dimensional stability, which are necessary for the cylinder head, are obtained.

Specifically, the casting aluminum alloy of the present invention, which has the above-described component composition, is subjected to the solution heat treatment under conditions where the temperature is 500 to 550° C. and the treatment time is 2.0 to 8.0 hours, and to the aging treatment under conditions where the temperature is 190 to 250° C. and the treatment time is 2.0 to 6.0 hours.

By the T7 treatment as described above, there can be obtained 50 HRB as hardness necessary from a viewpoint of preventing permanent set in fatigue of a seating surface of a head bolt and a gasket seal surface and ensuring abrasion resistance on a fastening surface of the cylinder head with a cylinder block, a sliding portion of a camshaft, and the like.

When the time of the solution heat treatment is ensured sufficiently, eutectic Si comes to have a roundish shape by diffusion, whereby the stress concentration is relieved, and the mechanical properties such as the ductility will be improved.

EXAMPLES

The present invention will be described below more in detail based on examples; however, the present invention is not limited to these examples.

(1) Boat-Like Sample Casting Test

Aluminum alloys with compositions shown in FIG. 2 were molten by an electric furnace, and were subjected to the microfabrication treatment and the Si improvement treatment, and thereafter, boat-like samples with dimensions of 190×40×25 mm were cast. Then, the boat-like samples were subjected to the T7 treatment (solution heat treatment at 530° C. for 5 hours, and then aging treatment at predetermined temperature between 180 to 260° C. for 4 hours). Thereafter, fatigue test pieces and tensile test pieces were cut out of the treated boat-like samples. For each of the test pieces, the high cycle fatigue strength and the fracture elongation were measured, and the hardness Rockwell B-scale (HRB) was measured.

Results of these are shown in FIG. 2 in combination. With regard to target values of these, a target value of the high cycle fatigue strength is set at 100 MPa or more, a target value of the elongation as the alternative properties of the thermal fatigue strength is set at 10.0% or more, and a target value of the hardness is set at 50 HRB or more.

Note that, in the high cycle fatigue test, an Ono-type rotating bending fatigue test machine was used, and the number of revolutions thereof was set at 3600 rpm. Then, the fatigue strength of each test piece was evaluated based on a stress amplitude value when the number of repeated bending cycles up to the fracture was $10^7$ times.

As apparent from FIG. 2, in Examples 1 to 9 where the test pieces contained the alloy components with mass percents of the predetermined ranges and were subjected to the T7 treatment at the aging temperatures of 200 to 240° C., it was confirmed that the test pieces exhibited good performance in all of the high cycle fatigue strength, the fracture elongation and the hardness.

As opposed to this, in Comparative examples 1 to 10 where the alloy components and the aging temperatures went out of the ranges defined by the present invention, and in Conventional materials 1 and 2 using the AC4CH alloy and the AC2A alloy, which have been used as the conventional cylinder head material, it was found out that at least one of the properties, that is, the fatigue strength, the fracture elongation and the hardness, was low in each test piece thereof, whereby it was impossible to obtain such strength as meeting requirements for a cylinder head material of a high-performance engine.

(2) Cylinder Head Casting Test

The alloys showing relatively good performance in the boat-like sample casting test were chosen from the above described Examples and Comparable Examples. Then, actual bodies of the cylinder heads of the alloys chosen were cast in a metal die, and were subject to the T7 treatment corresponding to that in the boat-like sample casting test.

Thereafter, fatigue test pieces and tensile test pieces were cut out of positions of the cylinder heads cast and treated, which were in the vicinities of the surfaces of the combustion chambers, and were subjected to measurements of the high cycle fatigue strength and the fracture elongation in a similar way to the above, and in addition, were subjected to measurements of the hardness Rockwell B-scale (HRB).

Results of these are shown in FIG. 3. With regard to target values in this case, a target value of the high cycle fatigue strength is set at 85 MPa or more, and a target value of the hardness is set at 50 HRB or more.

Moreover, with regard to the thermal fatigue strength, a simple thermal fatigue test in which a temperature cycle was set as 40° C.-270° C.-40° C. was carried out under completely restrained conditions by using flat test pieces added with V notches, and a target value of results of the simple thermal fatigue strength was set at no less than 100 that is a thermal fatigue lifetime of a TIG-remolten article from the conventional AC2A alloy.

As apparent from the results shown in FIG. 3, also in the castings of the actual bodies of the cylinder heads, it was confirmed that the test pieces in Examples 2-2 and 6-2 corresponding to Examples 2 and 6 of the boat-like sample casting test exhibited good performance in the high cycle fatigue strength, the thermal fatigue lifetime and the hardness, and met, at a high level, the properties required for the cylinder head.

As opposed to this, though relatively good evaluation results were obtained by the boat-like samples in Comparative examples 4-2 and 8-2 corresponding to Comparative examples 4 and 8 of the boat-like sample casting test, the fatigue strength and the thermal fatigue lifetime were decreased in Comparative example 4-2 owing to an influence of the casting defects, which did not appear in the boat-like samples, since the actual body of the cylinder head was thick-walled.

Meanwhile, with regard to Comparative example 8-2 where the target value was almost achieved in the boat-like sample casting test, the strength thereof was also low in the actual body test. This is considered to be because Si was not improved by Sr.

The entire content of Japanese Patent Application No. TOKUGAN 2007-177983 with a filing date of Jul. 6, 2007, is hereby incorporated by reference.

What is claimed is:

1. A cylinder head for an internal combustion engine, wherein the cylinder head comprises an aluminum alloy casting, wherein the aluminum alloy comprises:

in terms of mass ratios, 4.0 to 6.0% of Si, 0.5 to 1.3% of Cu, 0.25 to 0.5% of Mg, no more than 0.5% of Fe, no more than 0.07% of Mn, 0.002 to 0.02% of Sr; and Al and inevitable impurities, which are residues, wherein the cylinder head has a high cycle fatigue strength of 100 MPa or more, an elongation of 10.0% or more, and a hardness of 50 HRB or more in a vicinity of a surface of a combustion chamber; and wherein the Mn is present as an intentional addition.

2. The cylinder head for an internal combustion engine according to claim 1, wherein the cylinder head has a dendrite structure with a dendrite arms spacing of 30 μm or less at a surface of the combustion chamber so as to preserve a thermal fatigue strength of the cylinder head.

3. The cylinder head for an internal combustion engine according to claim 1, wherein, in terms of mass ratios, the aluminum alloy comprises 0.3 to 0.4% Mg.

4. The cylinder head for an internal combustion engine according to claim 1, wherein a ratio of Fe:Mn is 1:1 to 2:1.

5. A cylinder head for an internal combustion engine, wherein the cylinder head comprises an aluminum alloy casting, wherein the aluminum alloy comprises:

in terms of mass ratios, 4.0 to 7.0% of Si, 0.5 to 1.3% of Cu, 0.25 to 0.5% of Mg, no more than 0.5% of Fe, no more than 0.07% of Mn, 0.002 to 0.02% of Sr, and at least one component selected from the group consisting of 0.005 to 0.2% of Ti, 0.005 to 0.2% of B and 0.005 to 0.2% of Zr; and Al and inevitable impurities, which are residues, wherein the cylinder head has a high cycle fatigue strength of 100 MPa or more, an elongation of 10.0% or more, and a hardness of 50 HRB or more in a vicinity of a surface of a combustion chamber; and wherein the Mn is present as an intentional addition.

6. The cylinder head for an internal combustion engine according to claim 5, wherein the cylinder head has a dendrite structure with a dendrite arms spacing of 30 μm or less at a surface of the combustion chamber so as to preserve a thermal fatigue strength of the cylinder head.

7. The cylinder head for an internal combustion engine according to claim 5, wherein, in terms of mass ratios, the aluminum alloy comprises 0.3 to 0.4% Mg.

8. The cylinder head for an internal combustion engine according to claim 5, wherein a ratio of Fe:Mn is 1:1 to 2:1.

* * * * *